US006214421B1

(12) United States Patent
Pidzarko

(10) Patent No.: US 6,214,421 B1
(45) **Date of Patent: *Apr. 10, 2001**

(54) METHOD OF POWDER COATING

(76) Inventor: Dennis Pidzarko, 97, 51308 Range Road 224, Sherwood Park, Alberta (CA), T8C 1H3

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/195,819

(22) Filed: Nov. 19, 1998

Related U.S. Application Data

(63) Continuation-in-part of application No. 08/833,724, filed on Apr. 9, 1997, now abandoned.

(51) Int. Cl.[7] ..... B05D 1/04; B05D 3/00

(52) U.S. Cl. ..... 427/475; 427/477; 427/478; 427/485; 427/195; 427/315; 427/317; 427/421

(58) Field of Search ..... 427/458, 470, 427/475, 478, 479, 485, 486, 299, 315, 316, 322, 195, 421, 422, 477

(56) References Cited

U.S. PATENT DOCUMENTS 3,342,621 * 9/1967 Point et al. .
3,809,011 * 5/1974 Fabre et al. .
3,908,036 * 9/1975 Milleson .
3,919,437 * 11/1975 Brown et al. .
4,537,120 * 8/1985 Josefison .
5,149,563 * 9/1992 Collier .
5,344,672 * 9/1994 Smith .
5,364,657 * 11/1994 Throne .
5,753,302 * 5/1998 Sun et al. .
5,824,373 * 10/1998 Biller et al. .

OTHER PUBLICATIONS

Thin Films Science & Technology 6 "Coatings On Glass", HK Pulker 2nd Ed., pp. 52–55, 1984.*
"Power Coating" The Complete Finishers Handbook, N. Liberto, ed. p. 44, 1994.*

* cited by examiner

*Primary Examiner*—Fred J. Parker
(74) *Attorney, Agent, or Firm*—Davis and Bujold

(57) ABSTRACT

A method of powder coating at least one surface of a non-conductive object having a plurality of sequential steps. The first step is pretreating the surface of the non-conductive object to ensure that the surface is suitably cleaned. The second step to apply a sufficient quantity of moisture on the surface of the non-conductive object to facilitate adhesion of a powder coating to the surface. The next step is to spray a polymer coating powder on the moistened surface of the non-conductive object. This spraying step is done immediately following the application of moisture but prior to a complete evaporation of the applied moisture. The fifth step is to evaporate any remaining applied moisture from the non-conductive object prior to curing. The last step is to cure the coating on the surface of the non-conductive object without decomposing the powder and then either cool or allow the non-conductive object to cool naturally.

23 Claims, 1 Drawing Sheet

METHOD OF POWDER COATING

This application is a Continuation-in-Part of Ser. No. 08/833,724 filed Apr. 9, 1997 now abandoned.

FIELD OF THE INVENTION

The present invention relates to a method of powder coating, applicable to powder coating any type of material and, in particular, wood and other non-metallic surfaces.

BACKGROUND OF THE INVENTION

Conventional powder coating processes involve spraying a coating of polymer plastic powder onto an object, and then applying heat to the coating. The heat applied must be sufficient to cure the powder and, if applicable, to enable it to chemically react, but not so extreme in either time or duration as to cause the polymer to start to decompose. When heat is removed, the powder hardens onto the object.

In theory, powder coating will work effectively with any object that can withstand the application of the heat necessary to melt the powder. In practice, however, problems are often encountered in getting the powder to adhere to the object. In an effort to improve adherence of powder, the object being coated is commonly heated or electrostatically charged.

A particularly difficult material to get a polymer plastic powder to adhere to is wood. Notwithstanding the heating of the wood and the use of electrostatic application methods, the quality of powder coating finishes on wood have generally been unsatisfactory.

SUMMARY OF THE INVENTION

What is required is a method of powder coating that will improve the adherence of the powder to the object being coated, particularly when that object is made of wood or other non-metallic materials.

According to the present invention there is provided a method of powder coating. A first step involves moisturizing a surface of an object which is to be coated with supersaturated steam to provide moisture on the surface just sufficient to cause powder to adhere to the surface. A second step involves spraying polymer coating powder onto the surface before the moisture evaporates, whereby moisture on the surface aids in the adhesion of the powder to the object. A third step involves curing the powder adhering to the surface after the moisture has evaporated from the surface, without decomposing the powder.

The method, as described above, has resulted in a greatly improved quality of coating. Having moisture on the application surface greatly enhances the ability of the powder to adhere to the surface, much as the licking one's finger enhances one's ability to pick up sugar. The teaching in the prior art of heating the object and immersing it in a fluidized bed of powder, is believed to be counter-productive, especially when coating objects made of wood which have limitations on the temperature to which they can be heated. When working with metal, care must be taken to avoid excessive moisture, as excessive moisture will adversely effect the quality of the coating. Wood and other non-metallic materials are believed to be best suited for the application of this method.

Although beneficial results may be obtained through the use of the method, as described above, even more beneficial results may be obtained when a plurality of spray nozzles are used to apply the powder which generate a low velocity powder mist. In the prior art, the spray nozzles utilized were generally high volume/high velocity jets which bombarded the object with powder. It is believed that such high volume/high velocity sprays are counter-productive. When the object is dry such sprays tend to polish the application surface. This is especially the case with wood. This polishing effect actually clears powder from the application surface. It is, therefore, preferred that the spray nozzles generate a low velocity powder mist onto the moist application surface.

BRIEF DESCRIPTION OF THE DRAWING

These and other features of the invention will become more apparent from the following description in which reference is made to the appended drawing, wherein:

THE FIGURE is a schematic representation of a method of powder coating in accordance with the teaching of the present invention.

DETAILED DESCRIPTION OF THE PREFERRED EMBODIMENT

Figure 1:
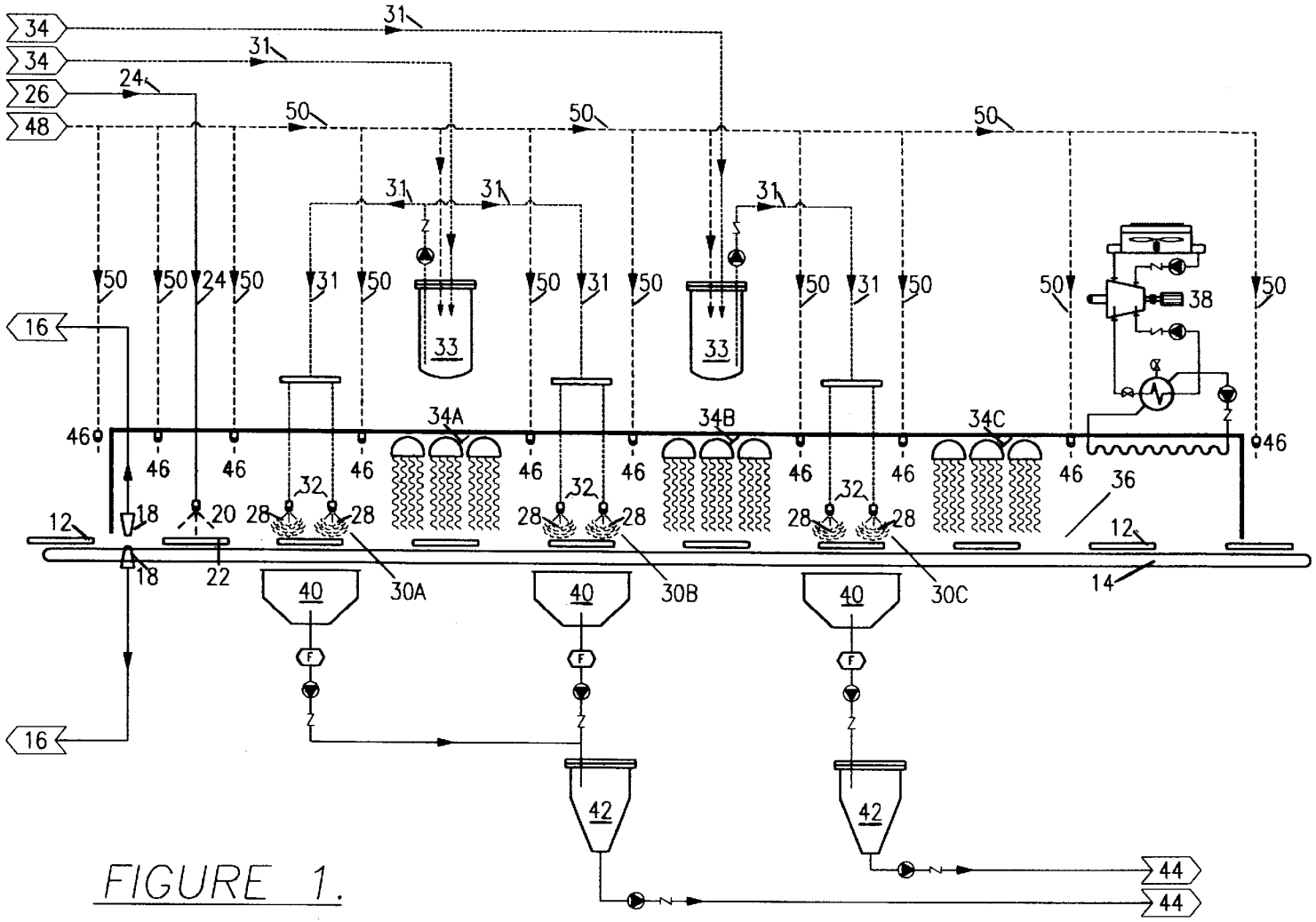

The preferred method of powder coating will now be described with reference to THE FIGURE.

The preferred manner of performing the method steps, which will hereinafter be described, is to position an object 12 on a conveyor 14 and then subject object 12 to the method steps sequentially as conveyor 14 advances. Prior to being subjected to the method steps, object 12 must be suitably cleaned. The preferred manner of doing this is by means of vacuums 16 with vacuum heads 18 disposed about conveyor 14. It may also be desirable to subject object 12 to other pretreatment, depending upon the materials out of which object 12 is made. It is preferred that wood products be sanded and vacuumed.

The preferred method of powder coating, with presently contemplated enhancements, includes the following steps. The first step involves moisturizing object 12, prior to it being sprayed, by passing object 12 through a steam chamber 20. When object 12 has completed passing through steam chamber 20 it has a moist application surface 22. Steam chamber 20 is connected by conduit 24 to a source of steam 26. Although this method can be used with any material, wood is believed to be best suited for the application of this method, as it tends to temporarily hold moisture on its surface. Moisture can be detrimental to the coating process if excess moisture is released during heating.

The second step involves spraying polymer coating powder 28 onto the moist application surface 22 by passing object 12 through the spray chamber 30*a*. Spray chamber 30*a* has a plurality of spray nozzles 32 which generate a low velocity powder mist. The moisture on application surface 22 has been found to facilitate the adhesion of powder 28 to object 12. The powder is delivered to spray chamber 30*a* by conduit 31. A spray unit 33 is used to draw powder from a powder reservoir 34 and deliver the powder through conduit 31 to spray nozzles 32. Although not essential, it is preferred that the powder be applied using a spray application process. Having a moist application surface 22 has been found to enhance the spray application process, with better adherence of powder along edges and in recesses. The spray application can be, but need not be, performed in combination with conventional electrostatic processes.

The third step involves curing powder 28 adhering to application surface 22. The preferred manner of curing powder 28 is by heating. There are alternative curing processes such as through the use of radiation. Powder 28 is brought to a temperature sufficient to melt and react, without decomposing, by passing object 12 through at least a first curing chamber 34*a* in which is disposed a heat source. A heat source is preferred that is capable of heating powder 28, with the least penetration possible with respect to object 12. A penetrating heat source is to be avoided, as it is unnecessary and undesirable to heat object 12. Heating of object 12 results in thermal expansion, with inevitable thermal contraction when object 12 cools. Thermal contraction during cooling can adversely effect the adherence of the coating.

It is viewed as being desirable to have flexibility to apply a plurality of thin coats of powder or one thick coat. When a plurality of thin coats are desired, additional steps may be added relating to placing of second, third and perhaps subsequent coats on object 12. Spraying a second coat of polymer coating powder 28 onto object 12 by passing object 12 through a second spray chamber 30*b*. Heating the second coat of powder 28 adhering to object 12 to a temperature sufficient to melt, without decomposing, powder 28 by passing object 12 through a second curing chamber 34*b*. Spraying a third coat of polymer coating powder 28 onto object 12 by passing object 12 through a third spray chamber 30*c*. Heating powder 28 adhering to object 12 to a temperature sufficient to melt, without decomposing, the powder 28 by passing object 12 through a third curing chamber 34*c*.

It is preferred that a further and final step be taken of passing object 12 through a cooling chamber 36. Cooling chamber 36 is kept cool by means of a refrigeration unit, generally indicated by reference numeral 38.

It is preferred that spray chambers 30*a*, 30*b*, 30*c* have powder recovery and recirculation means. The powder recovery and recirculation means include a plurality of powder recovery sumps 40 connected to recovery tanks 42 and to recirculation conduit 44.

Each chamber described above, must be isolated from the other chambers. It is preferred that this be accomplished by means of by air generated curtains 46. A source of inert air 48 is connected by means of air conduit 50 to each air curtain 46. Each chamber is isolated from outside air and from the other chambers.

As the application of moisture to an object surface during a powder coating process runs contrary to current practices, the moisture application will now be further described. The process has particular utility for obtaining adhesion of powder to non-conductive substrates, where there would otherwise be no adhesion, poor adhesion of irregular adhesion of the powder; such as wood, plastic, and cardboard. When wood is being coated, the wooden object is prepared by standard procedures for wood working. The wood is cut to the desired design, sanded, and vacuumed to produce a uniform clean surface free of oils and dirt.

The steam chamber consists of a cabinet into which wood panels or other types of non-conductive objects can be rapidly introduced and retrieved. An example of a way in which this can be done is a chamber with a roller conveyor system, in which wood parts are carried rapidly, tunnel style, through the chamber on rollers. The chamber is equipped with an array of nozzles through which saturated steam is directed onto the object. The arrangement of nozzles can be adjusted for uniform application of steam to the object. The nozzles direct steam at the part, but also ensure that the steam chamber is completely filled with saturated steam. Care must be taken to ensure that drops of condensed water cannot fall on the workpiece as it passes through the chamber, as this is highly detrimental to resulting coating quality.

Steam is preferably generated by heating water to boiling and directing the resulting saturated vapour through steam lines into the steam chamber. The steam lines are, preferably, well insulated so that the temperature of the steam does not drop significantly. A small amount of moisture that does condense, should be drawn off separately so that is not introduced into the steam chamber. The steam is supersaturated, and is visible as a "cloud of steam". The process works best when hot steam (near the boiling point of water) is used. It would be possible to carry out the process at low temperatures, including room temperatures. At room temperature "supersaturated steam" can be created with an atomizer by passing liquid water through a nozzle to produce a cloud of droplets an vapour. The atomized water is projected onto the wood surface, resulting in a moisturized surface which can be powder sprayed. The process will not be as effective at lower temperatures as it is when hot steam is used. The reason for this is that the moisture must be evaporated before cure. With hot steam this evaporation occurs very rapidly. At room temperature additional time or a heating step may be required after spraying, but before curing. Humidity, that is moisture at a relative humidity of less than 100%, (not visible as a cloud) would not be as effective in this process and possibly would not be effective at all.

The process works best when moisture application, powder spraying, and evaporating occur rapidly in succession. Timing and co-ordination of these processes is essential to successful operation of the process. This co-ordination will now be described with reference to a pilot plant that was developed to prove this process. In the pilot plant, the moisturizing process takes about 15 to 20 seconds, which is the time required for the object to pass through the steam chamber. The steam temperature is slightly below the boiling temperature of water. The moisturized wood immediately passes into the powder spray chamber, for powder application. It takes about 25 seconds for the panel to pass through the spray chamber, at which time much of the moisture has evaporated. Another 25 to 30 seconds pass before the coated panel enters the cure chamber, the additional seconds help ensure complete evaporation of moisture prior to curing. Moisture application and evaporation must occur rapidly. It is highly undesirable for the moisture to penetrate into the wood, as release of water vapour from the wood would create problems during curing. It is very important that the moisturized wood be transferred immediately from the humidity cabinet to the spray booth, as moisture rapidly evaporates and the benefit to powder adhesion are lost. It should be noted that the rapid nature of the process will provide a commercial advantage.

The following guidelines are provided to assist in determining an appropriate amount of moisture. An appropriate amount of moisture has been applied to the wood surface when the powder coating uniformly adheres to the surface, and the moisture fully evaporates prior to cure.

Currently moisturized pieces. When the wood object emerges from the steam chamber, the wood has darkened considerably, due to moisture on the surface. The surface of such pieces will feel moist to the touch. If passed immediately through the spray chamber, without spraying, the pieces lose the dark colour (ie. their moisture) by the time they leave the spray chamber.

Inadequately moisturized pieces. The pieces are not adequately moisturized if the powder coating will not stick to the surface.

Over moisturized pieces. The pieces are over moisturized if free water (droplets or films) can be observed on the surface. Excessive moisture interfaces with the uniform application of powder to the surface, causing it to clump or flow.

In summary, the correct amount of moisture is that amount which rapidly absorbs onto the surface of the wood without deep penetration or without leaving a thin film of moisture on the surface. The correct amount of moisture can be applied to the wood surface by varying the following parameters to optimize the process; steam temperature, steam delivery rate, residence time of the object in the steam chamber, residence time of the object in the spray chamber. The correct amount of moisture will vary with the type of substrate being coated. For example, some woods absorb little water, and with such woods a small amount of moisture must be applied very rapidly followed rapidly by spraying. Other woods are highly absorbent and with such woods larger amounts of moisture must be applied to ensure wetness. Consequently, additional time is required for evaporation of the moisture prior to cure.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A method of coating an exterior surface of a non-conductive object with a heat curable powder, the method comprising the steps of:

cleaning the exterior surface of the non-conductive object to clean the exterior surface;

pretreating the exterior surface of the non-conductive object by spraying a sufficient quantity of moisture, at a relative humidity of not less than 100%, to the cleaned exterior surface of the non-conductive object, without formation of any water droplets on the cleaned exterior surface, to facilitate adhesion of powder thereto;

spraying a polymer coating powder onto the exterior surface of the non-conductive object following completion of applying a sufficient quantity of moisture to the exterior surface of the non-conductive object but prior to complete evaporation of the applied moisture from the exterior surface of the non-conductive object;

evaporating remaining moisture on the exterior surface of the non-conductive object prior to commencing curing of the non-conductive object; and curing the polymer coating powder to the exterior surface of the non-conductive object, once all remaining moisture on the non-conductive object is evaporated, without decomposing the polymer coating powder.

2. The method of powder coating according to claim 1, further comprising the steps of placing the non-conductive object on a moving surface and moving the moving surface to sequentially subject the exterior surface of the non-conductive object to the cleaning step, the pretreating step, the spraying step, the evaporating step and the curing step.

3. The method of powder coating according to claim 1, further comprising the step of moisturizing the exterior surface of the non-conductive object with supersaturated steam.

4. The method of powder coating according to claim 1, further comprising the step of spraying the powder onto the exterior surface of the non-conductive object in a spray chamber having a plurality of powder spray nozzles.

5. The method of powder coating according to claim 1, further comprising the step of curing the powder on the exterior surface of the non-conductive object in a curing chamber at a temperature which is sufficient to melt and cure the polymer powder but is insufficient for the heat to penetrate into the exterior surface of the non-conductive object and result in thermal expansion thereof.

6. The method of powder coating according to claim 1, further comprising the step of electrostatically spraying the powder after electrically grounding the exterior surface of the non-conductive object.

7. The method of powder coating according to claim 1, further comprising the steps of:

cooling the cured exterior surface of the non-conductive object following the curing step;

sequentially placing a steam chamber, a spraying chamber, an evaporation chamber and a curing chamber in order, separating the steam chamber from the spraying chamber by a first air curtain, separating the spraying chamber from the evaporation chamber by a second air curtain, and separating the evaporation chamber from the curing chamber by a third air curtain.

8. The method of powder coating according to claim 1, further comprising the steps of:

using a thermoplastic material as the polymer coating powder and performing the pretreating step, the spraying step, the evaporating step and the curing step within a time period determined by a line speed of a moving surface supporting the non-conductive object;

spraying a second thermoplastic polymer coating powder onto a previously coated and heated exterior surface of the non-conductive object, prior to solidification of the first thermoplastic polymer coating powder, with the second spraying step being performed in a spray chamber having a plurality of powder spray nozzles which spray a powder mist that adheres to the previously coated and heated exterior surface of the non-conductive object;

passing the previously coated and heated exterior surface of the non-conductive object through a second curing chamber to heat the second thermoplastic polymer coating powder to the previously coated and heated exterior surface of the non-conductive object without decomposing the thermoplastic polymer coating powder;

spraying a third thermoplastic polymer coating powder onto the previously coated and heated exterior surface of the non-conductive object, prior to solidification of the second thermoplastic polymer coating powder, with the third spraying step being performed in a third spray chamber having a plurality of powder spray nozzles which spray a powder mist that adheres to the previously coated and heated exterior surface of the non-conductive object; and passing the previously coated and heated exterior surface of the non-conductive object through a third curing chamber to heat and cure the third thermoplastic polymer coating powder to the previously coated and heated exterior surface of the non-conductive without decomposing the thermoplastic polymer coating powder.

9. The method of powder coating according to claim 1, further comprising the step of:

using a thermosetting plastic material as the polymer coating powder and preforming the pretreating step, the spraying step, the evaporating step and the curing step within a time period determined by a line speed of a moving surface supporting the non-conductive object.

pretreating the exterior surface of the non-conductive object by spraying a further sufficient quantity moisture onto the exterior surface of the non-conductive object;

spraying a second thermosetting polymer coating powder onto a previously coated and cured exterior surface of the non-conductive object with the second spraying step being performed in a spray chamber having a plurality of powder spray nozzles which spray a powder mist that adheres to the previously coated and cured exterior surface of the non-conductive object;

passing the previously coated and cured exterior surface of the non-conductive object through a second curing chamber to heat and cure the second thermosetting polymer coating powder to the previously coated and cured exterior surface of the non-conductive object without decomposing the thermosetting polymer coating powder;

pretreating the exterior surface of the non-conductive object by spraying a still further sufficient quantity moisture onto the exterior surface of the non-conductive object;

spraying a third thermosetting polymer coating powder onto the previously coated and cured exterior surface of the non-conductive object with the third spraying step being performed in a third spray chamber having a plurality of powder spray nozzles which spray a powder mist that adheres to the previously coated and cured exterior surface of the non-conductive object; and passing the previously coated and cured exterior surface of the non-conductive object through a third curing chamber to heat and cure the third thermosetting polymer coating powder to the previously coated and cured exterior surface of the non-conductive without decomposing the thermosetting polymer coating powder.

10. The method of powder coating according to claim 1, further comprising the steps of using a thermoplastic material as the polymer coating powder and preforming the pretreating step, the spraying step, the evaporating step and the curing step within a time period determined by a line speed of a moving surface supporting the non-conductive object;

A) spraying a second thermoplastic polymer coating powder onto a previously coated and heated exterior surface of the non-conductive object, prior to solidification of a first thermoplastic polymer coating powder, with the second spraying step being performed in a spray chamber having a plurality of powder spray nozzles which spray a powder mist that adheres to the previously coated and heated exterior surface of the non-conductive object;

B) passing the previously coated and heated exterior surface of the non-conductive object through a second curing chamber to heat the second thermoplastic polymer coating powder to the previously coated and heated exterior surface of the non-conductive without decomposing the thermoplastic polymer coating powder; and repeating steps A) and B) above as necessary to sufficiently coat the exterior surface of the non-conductive object as desired.

11. The method of powder coating according to claim 1, further comprising the step of using a thermosetting plastic material as the polymer coating powder and preforming the pretreating step, the spraying step, the evaporating step and the curing step within a time period determined by a line speed of a moving surface supporting the non-conductive object;

A) pretreating the exterior surface of the non-conductive object by spraying a further sufficient quantity moisture onto the exterior surface of the non-conductive object;

B) spraying a second thermosetting polymer coating powder onto a previously coated and cured exterior surface of the non-conductive object with the second spraying step being performed in a spray chamber having a plurality of powder spray nozzles which spray a powder mist that adheres to the previously coated and cured exterior surface of the non-conductive object;

C) passing the previously coated and cured exterior surface of the non-conductive object through a second curing chamber to heat and cure the second thermosetting polymer coating powder to the previously coated and cured exterior surface of the non-conductive object without decomposing the thermosetting polymer coating powder; and repeating steps A), B) and C) above as necessary to sufficiently coat the exterior surface of the non-conductive object as desired.

12. A method of coating an exterior surface of a non-conductive wood object with a heat curable powder, the method comprising the steps of:

cleaning an exterior surface of the non-conductive wood object to clean the exterior surface;

pretreating the exterior surface of the non-conductive wood object by spraying a sufficient quantity of moisture, at a relative humidity of not less than 100%, to the exterior cleaned surface of the non-conductive wood object to darken an appearance of the exterior cleaned surface of the non-conductive wood object, without formation of any water droplets on the cleaned exterior surface, and facilitate adhesion of powder thereto;

spraying a polymer coating powder onto the exterior surface of the non-conductive wood object following completion of applying a sufficient quantity of moisture to the exterior surface of the non-conductive wood object but prior to complete evaporation of the applied moisture from the exterior surface of the non-conductive wood object;

evaporating remaining moisture on the exterior surface of the non-conductive wood object prior to commencing curing of the non-conductive wood object; and curing the polymer coating powder to the exterior surface of the non-conductive wood object, once all remaining moisture on the non-conductive wood object is evaporated, without decomposing the polymer coating powder.

13. The method of powder coating according to claim 12, further comprising the steps of placing the non-conductive wood object on a moving surface and moving the moving surface to sequentially subject the exterior surface of the non-conductive wood object to the cleaning step, the pretreating step, the spraying step, the evaporating step and the curing step.

14. The method of powder coating according to claim 12, further comprising the step of moisturizing the exterior surface of the non-conductive wood object with supersaturated steam.

15. The method of powder coating according to claim 12, further comprising the step of spraying the powder onto the exterior surface of the non-conductive wood object in a spray chamber having a plurality of powder spray nozzles.

16. The method of powder coating according to claim 12, further comprising the step of curing the powder on the exterior surface of the non-conductive wood object in a curing chamber at a temperature which is sufficient to melt and cure the polymer powder but is insufficient for the heat to penetrate into the exterior surface of the non-conductive wood object and result in thermal expansion thereof.

17. The method of powder coating according to claim 12, further comprising the step of electrostatically spraying the powder after electrically grounding the exterior surface of the non-conductive wood object.

18. A method of coating an exterior surface of a non-conductive plastic object with a heat curable powder, the method comprising the steps of:

cleaning an exterior surface of the non-conductive plastic object to clean the exterior surface;

pretreating the exterior surface of the non-conductive plastic object by spraying a sufficient quantity of moisture, at a relative humidity of not less than 100%, to the exterior cleaned surface of the non-conductive plastic object to absorb onto the exterior cleaned surface of the non-conductive plastic object, without formation of any water droplets on the cleaned exterior surface, and facilitate adhesion of powder thereto;

spraying a polymer coating powder onto the exterior surface of the non-conductive plastic object following completion of applying a sufficient quantity of moisture to the exterior surface of the non-conductive plastic object but prior to complete evaporation of the applied moisture from the exterior surface of the non-conductive plastic object;

evaporating remaining moisture on the exterior surface of the non-conductive plastic object prior commencing curing of the non-conductive plastic object; and curing the polymer coating powder to the exterior surface of the non-conductive plastic object, once all remaining moisture on the non-conductive plastic object is evaporated, without decomposing the polymer coating powder.

19. The method of powder coating according to claim 18, further comprising the steps of placing the non-conductive plastic object on a moving surface and moving the moving exterior surface to sequentially subject the exterior surface of the non-conductive plastic object to the cleaning step, the pretreating step, the spraying step, the evaporating step and the curing step.

20. The method of powder coating according to claim 18, further comprising the step of moisturizing the exterior surface of the non-conductive plastic object with supersaturated steam.

21. The method of powder coating according to claim 18, further comprising the step of spraying the powder onto the exterior surface of the non-conductive plastic object in a spray chamber having a plurality of powder spray nozzles.

22. The method of powder coating according to claim 18, further comprising the step of curing the powder on the exterior surface of the non-conductive plastic object in a curing chamber at a temperature which is sufficient to melt and cure the polymer powder but is insufficient for the heat to penetrate into the exterior surface of the non-conductive plastic object and result in thermal expansion thereof.

23. The method of powder coating according to claim 18, further comprising the step of electrostatically spraying the powder after electrically grounding the exterior surface of the non-conductive plastic object.

* * * * *